US005702330A

United States Patent [19]

De Monbrun et al.

[11] Patent Number: 5,702,330

[45] Date of Patent: Dec. 30, 1997

[54] MALE EXERCISE DEVICE AND METHOD

[76] Inventors: Michael A. De Monbrun; Dianne L. De Monbrun, both of 3086 Horizon Dr., Santa Ynez, Calif. 93460; Jammie Sant; David M. Sant, both of 4723 Don Pio Dr., Woodland Hills, Calif. 91364

[21] Appl. No.: 740,234

[22] Filed: Oct. 25, 1996

Related U.S. Application Data

[63] Continuation-in-part of Ser. No. 59,957, Sep. 18, 1996.

[51] Int. Cl.[6] ..... A63B 21/065

[52] U.S. Cl. ..... 482/105; 128/842

[58] Field of Search ..... 482/93, 105; 128/842, 128/844, 918; 604/347–353

[56] References Cited

U.S. PATENT DOCUMENTS

| | | | |
|---|---|---|---|
| D. 235,789 | 7/1975 | Eberhardt . | |
| 500,686 | 7/1893 | Corker | 482/105 |
| 1,729,209 | 9/1929 | Curtice | 482/105 |
| 3,263,432 | 8/1966 | Maskell | 482/105 |
| 3,820,780 | 6/1974 | Tarbox | 482/105 |
| 4,203,432 | 5/1980 | Koch . | |
| 4,967,738 | 11/1990 | March . | |
| 5,295,949 | 3/1994 | Hathaway . | |
| 5,472,399 | 12/1995 | Szekely . | |
| 5,526,803 | 6/1996 | Kelly . | |

OTHER PUBLICATIONS

Kegel, A., "Sexual Functions of the Puboloccyceus Muscle", *Western Journal of Surgery*, No. 60, pp. 521–524 (1952).

Zilbegelo, B., "Male Sexuality", pp. 108, 109, 215 and 216, (Little, Brown and Company) 1978.

Crooks, R.and Baur, K., "Ove Sexuality", 4th Ed., 1990 (The Benjamin/Cummings Publishing Company, Inc.).

*Primary Examiner*—Michael A. Brown

*Attorney, Agent, or Firm*—David Weiss

[57] ABSTRACT

An exercise device and method for strengthening the pubococcygeus muscle of a male person. In a preferred embodiment, the method includes the steps of providing a plurality of exercisers in accordance with the present invention, each such exerciser comprising a flexible elongate member having weighted end portions of substantially equal weight, the weight of each of the exercisers differing from the weight of the other exercisers of the plurality; selecting one of the exercisers; placing the selected exerciser on an erect penis of the male person such that the elongate member of the selected exerciser is flexurally retained on the penis with the weighted end portions thereof respectively dependent from opposite sides of the penis; and the male person performing Kegel exercises with the selected exerciser placed on the penis.

16 Claims, 2 Drawing Sheets

MALE EXERCISE DEVICE AND METHOD

CROSS REFERENCE TO RELATED APPLICATION

This application is a continuation-in-part of copending U.S. Design patent application Ser. No. 29/059,957 filed Sep. 18, 1996 by Michael A. De Monbrun, Dianne L. De Monbrun, Jammie Sant and David M. Sant.

BACKGROUND OF THE INVENTION

This invention relates to exercise devices and methods for increasing orgasmic experience in males, and more particularly to a device and the method of its use for increasing the effectiveness of male Kegel exercises.

A form of exercise, known as "Kegel exercises", was developed by Dr. Arnold Kegel as a way of helping women regain control of urination after childbirth. The exercises are effective in restoring muscle tone in the perineat area, and in particular the pubococcygeus muscle, but in addition Dr. Kegel noted that many women who practiced the Kegel exercises regularly reported an increase in sensation during intercourse as well as a general increase in genital sensitivity. See Kegel, A., "Sexual Functions of the Pubococcygeus Muscle", *Western Journal of Surgery*, vol. 60, pages 521–524 (1952).

Kegel exercises have been adapted for males with similar results. The portion of the penis which extends internally into the male pelvic cavity is surrounded by an extensive network of muscles, the most important of which is the pubococcygeus muscle. In most men these muscles are quite weak, and strengthening these muscles by performing Kegel exercises has resulted in reports of male benefits including stronger and more pleasurable orgasms, better ejaculatory control, and increased pelvic sensation during sexual arousal. See, for example, Crooks, R. and Baur, K., *Our Sexuality*, 4th Ed., 1990 (The Benjamin/Cummings Publishing Company, Inc.); and Zilbergeld, B., *Male Sexuality*, 1978 (Little, Brown and Company).

The pelvic muscles may be located in a male person, and Kegel exercises may be performed by him to strengthen these muscles and in particular the pubococcygeus muscle, in accordance with the following. The person may locate these muscles by squeezing his pelvic muscles while urinating to stop the flow of urine several times; the muscles which are squeezed to accomplish this are the ones which are used to perform the Kegel exercises. If a correct male Kegel exercise is performed while not urinating, the penis will move slightly. Kegel exercises done with a penile erection will cause the penis to move up and down. The process of squeezing and relaxing these muscles is called the Kegel exercise, or Kegel exercises, and each squeeze and relaxation is referred to as a "Kegel".

A suggested Kegel exercise program is outlined in Crooks and Bower, supra at page 160. The program involves performing fifteen "short Kegels" (i.e., without holding the contraction of each Kegel), twice daily. The number of short Kegels is gradually increased until the person can comfortably perform sixty at a time, twice daily. Thereafter, "long Kegels" are practiced by the person holding each contraction for a count of 3. The short and long Kegels in each daily exercise routine are then combined, doing a set of sixty of each, once or twice daily.

SUMMARY OF THE INVENTION

The present invention provides an exercise device and method for strengthening the pelvic muscles surrounding the penis, and in particular the pubococcygeus muscle. The method of the present invention utilizes the device of the invention in association with Kegel exercises performed by a male person.

Briefly described, the exercise device or exerciser of the present invention comprises a flexible elongate member having weighted ends or end portions of substantially equal weight, the elongate member adapted for being flexurally retained on an erect penis of a male person transversely of the penis with the weighted end portions respectively dependent from opposite sides of the penis while Kegel exercises are performed by the male person. The elongate member and its weighted end portions are preferably of rubber.

In a preferred embodiment of the exercise device according to the present invention, the elongate member includes a flexible strip having a first end and a second end, and the exercise device includes a first weight secured to the first end and a second weight secured to the second end, the two weights being of substantially equal weight. The strip and its secured weights are preferably of rubber and the weights are integral with the strip. Supplemental weights of density different than that of the rubber may be embedded in the first and the second weights.

According to one aspect of the present invention, a set or series of a plurality of such exercisers may be provided, each such exerciser comprising a flexible elongate member having weighted ends or end portions of substantially equal weight, the weight of each exerciser differing from the weight of the other exercisers of the plurality of exercisers, the elongate member of each of such exercisers adapted for being flexurally retained on an erect penis of the male person transversely of the penis with the weighted end portions of the retained elongate member dependent from opposite sides of the penis while Kegel exercises are performed by the male person. Supplemental weights of density different than that of the rubber of which the elongate member and its weighted end portions (or first and second weights) are fabricated, may be embedded in the weighted end portions (or in the first and second weights) of the exercisers, for providing the set or series of such exercisers including two or more exercisers in which the weighted end portions (or the first and second weights) of any one of the exercisers are of a different weight than the weighted ends (or the first and second weights) of the other exercisers of such set. The exercisers of the set includes indicia thereon respectively indicative of the differing weights of the exercisers.

Such a set of exercisers permits the person to utilize one exerciser with which he can comfortably and consistently perform a series of Kegel exercises and then move up to using another exerciser with heavier weighted end portions (or heavier first and second weights) with which he can comfortably and consistently perform a series of Kegel exercises.

The method in accordance with the present invention, for exercising the pubococcygeus muscle of a male person, comprises the steps of: (a) providing an exerciser comprising a flexible elongate member having weighted end portions; (b) placing the exerciser on an erect penis of the male person such that the elongate member is flexurally retained on the penis transversely thereof with the weighted end portions respectively dependent from opposite sides of the penis; and (c) the male person performing Kegel exercises with the exerciser placed in accordance with step (b). Preferably, during step (b), the exerciser is placed such that the elongate member is retained at or near the base of the penis.

During step (a), the end portions of the elongate member provided are substantially equally weighted and of a first predetermined weight, and the method may further include the steps of: (d) providing a second exerciser comprising a flexible elongate member having substantially equally weighted end portions of a second predetermined weight heavier than the first predetermined weight; (e) discontinuing steps (b) and (c); (f) placing the second exerciser on the erect penis of the male person such that the elongate member of the second exerciser is flexurally retained on the penis transversely thereof with the weighted end portions of the second exerciser respectively dependent from opposite sides of the penis; and (g) the male person performing Kegel exercises with the second exerciser placed in accordance with step (f).

Preferably, the method according to the present invention, for exercising the pubococcygeus muscle of a male person, comprises the steps of: (a) providing a plurality of exercisers each comprising a flexible elongate member having weighted end portions of substantially equal weight differing from the weight of the weighted end portions of the other exercisers of such plurality; (b) selecting one of the exercisers from the plurality; (c) placing the selected exerciser on the erect penis of the male person such that the elongate member of the selected exerciser is flexurally retained on the penis with the weighted end portions thereof respectively dependent from opposite sides of the penis; and (d) the male person performing Kegel exercises with the selected exerciser placed in accordance with step (c). During step (c), the exerciser is preferably placed such that the elongate member is retained at or near the base of the penis.

BRIEF DESCRIPTION OF THE DRAWING

The novel features which are believed to be characteristic of the invention, together with further advantages thereof, will be better understood from the following description considered in connection with the accompanying drawings in which a preferred embodiment of the invention is illustrated by way of example. It is to be expressly understood, however, that the drawings are for the purpose of illustration and description only and are not intended as a definition of the limits of the invention.

DESCRIPTION OF THE PREFERRED EMBODIMENT

Figure 1:
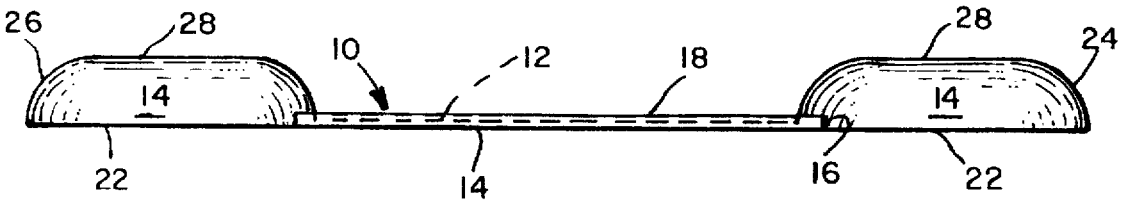
FIG. 1 is a front elevation view of a preferred embodiment of the male pubococcygeus muscle exerciser according to the present invention.
Figure 2:
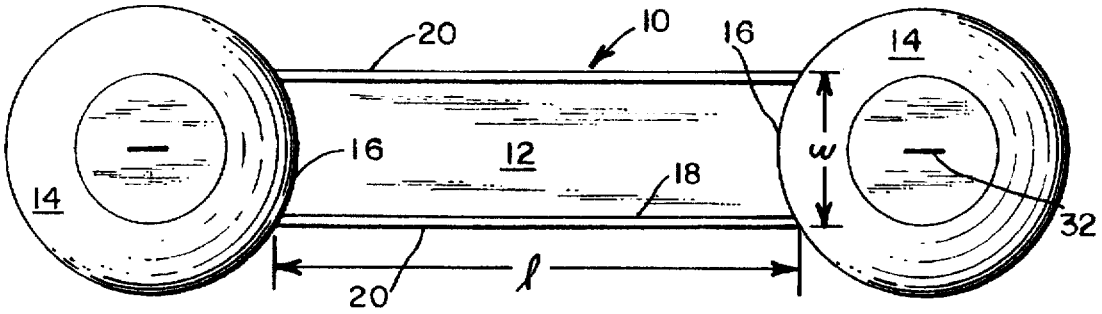
FIG. 2 is a top plan view of the exerciser of FIG. 1.

Turning first to FIGS. 1 and 2, a preferred embodiment of an exerciser 10 according to the present invention includes a flexible elongate member such as a flexible strip 12, having weighted end portions 14, i.e. weights 14 respectively secured to the ends 16 of the strip 12. The strip 12 is of a thickness and is fabricated of a material for permitting the strip 12 to be freely flexible, at least along its longitudinal dimension or length l, and the strip material is sufficiently soft for comfortably engaging the penis of a person during use in accordance with the method of the present invention. One suitable material is a soft rubber, for example a 40 durometer general purpose silicone rubber of specification ZZ-R-765. In one suitable example of an exerciser 10 in which the strip 12 was fabricated of this type of rubber, the thickness of the strip 12 was approximately ⅛ inch with a ridge 18 along each of the strip's longitudinal edges 20 of approximately 1/16 inch wide and approximately 1/32 inch in height as viewed in the drawing of FIG. 1 (i.e. in the thickness dimension of the strip 12).

The weighted end portions or weights 14 are respectively secured to the strip ends 16, and are substantially of equal weight or equally weighted, so as to apply substantially equal gravitational force to the ends 16 of the strip 12, pulling the strip ends 16 downwardly when the strip 12 is supported approximately mid-length. The end portions 14 are preferably fabricated of the same rubber material as the strip 12, but are of substantially greater bulk so as to function as weights, and preferably the exerciser 10 is fabricated in one piece such that the weighted end portions or weights 14 are integral with the strip 12 and in such manner are secured to the strip ends 16.

In the preferred exerciser embodiment 10, the end portions 14 are each circular or oval in plan configuration, with a flat bottom surface 22 continuing from the flat bottom surface 24 of the strip 12, and with sides 26 curving convexly upwardly (as viewed in the drawing of FIG. 1) such that the thickness of each end portion 14 is substantially greater than the thickness of the strip 12. The bottom surface area of each end portion 14 and its average thickness or height results in each end portion 14 of substantial bulk relative to the strip 12 so as to place most of the weight of the exerciser 10 at the ends 16 of the strip 12, and the weight distribution of the end portions 14 with respect to the strip 12 causes the bottom surfaces 22 of the end portions 14 to be in substantially parallel vertical planes when the strip 12 is supported approximately mid-length with the surfaces 22 facing each other (see FIGS. 6 and 7).

In the previously noted example of an exerciser 10 according to the preferred embodiment, the flexible strip 12 had a length l of approximately 4 inches, a width w of approximately 1¼ inches; each of the end portions 14 has a circular bottom surface 22 approximately 2⅛ inches in diameter, and a thickness or height (as viewed in the drawing of FIG. 1) of approximately ⅝ inch diameter. In this example, the top surface 28 of each of the end portions 14 was flat, forming a circular area of approximately 1 inch diameter meeting the convexly curving side surface 26 of the end portion 14. The weight of this example of the exerciser 10, fabricated of the rubber material previously described, was approximately 4 ounces, with each of the weighted end portions 14 being approximately 1¾ ounces.

Figure 3:
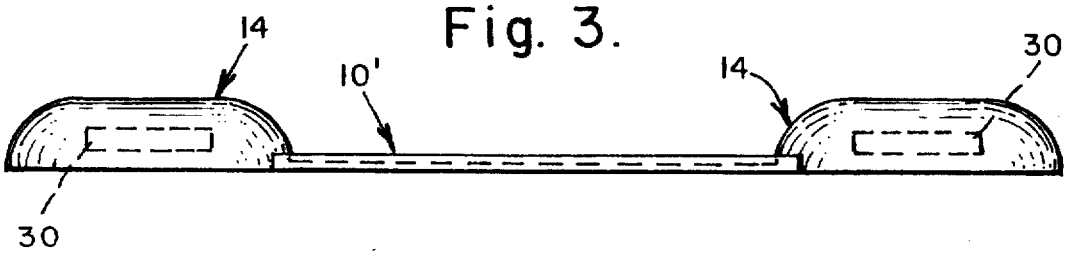
FIG. 3 is a front elevation view of a variation of the exerciser shown in FIG. 1.
Figure 4:
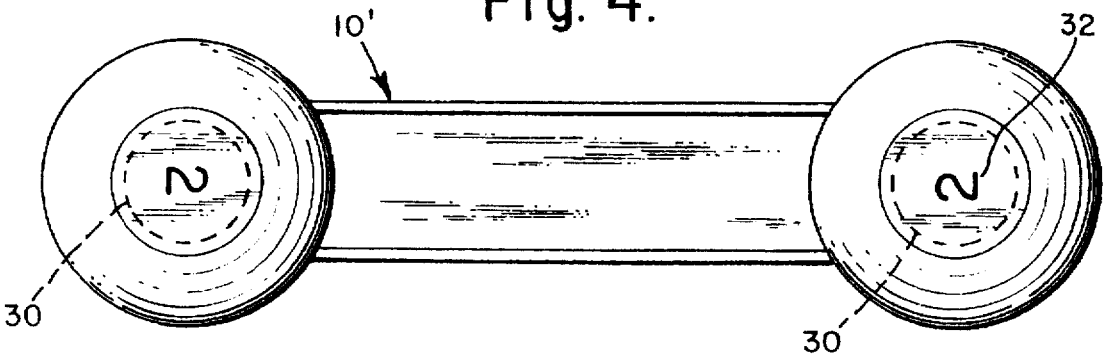
FIG. 4 is a top plan view of the exerciser shown in FIG. 3.

The present invention provides, in its preferred form, a set of a plurality of exercisers similar to the exerciser 10 of FIGS. 1 and 2, with each exerciser 10 being of a different weight than the other exercisers 10 of the set. According to a preferred embodiment of such a set, a plurality of exercisers may be provided with the exercisers being substantially identical in construction and configuration with the exerciser 10 shown in FIG. 1, with the exception that the weight of any one of the exercisers 10 differs from the weight of any other one of the exercisers 10. Preferably, the equally weighted end portions 14 of any one of the exercisers 10 differ from the weight of the equally weighted end portions 14 of any of the other exercisers 10 of the set. This is illustrated in FIGS. 3 and 4, in which a second exerciser 10' is substantially identical to the first described exerciser 10, with the exception that the second exerciser 10' further includes supplemental weights 30 of equal weight respectively embedded in its end portions 14. The supplemental weights 30 are of a density which is different than the density of the rubber material of which the end portions 14 are fabricated. If the density of the supplemental weights 30 is less than that of the rubber material, the weight of the second exerciser 10' will of course be less than the weight of the first exerciser 10. If, however, the density of the inserted supplemental weights 30 is greater than that of the rubber material, the weight of the end portions 14 of the second exerciser 10' will be greater than the weight of the end portions 14 of the first exerciser 10, and accordingly the weight of the second exerciser 10' will be greater than the weight of the first exerciser 10. The supplemental weights 30 may be in the form of disks as indicated in FIGS. 3 and 4, and may be of any suitable material such as wood, plastic, metal or other rubber materials of density different than the density of the rubber material used in fabricating the strip 12 and the integral end portions 14.

Each of the exercisers in a set are of a predetermined weight which may be used for practicing the method of the present invention. In an example of a set of two exercisers wherein the first exerciser 10 comprises the example described above and weighs approximately 4 ounces with the weight of each of its end portions 14 being approximately 1 ¾ ounces, the weight of the second exerciser 10' was approximately 6 ounces with the weight of each of its end portions 14 being approximately 2¾ ounces. In order to distinguish the two exercisers from each other, the exercisers 10, 10' may each have thereon indicia 32, such as the numeral "1" imprinted or embossed on the first exerciser 10 (such as on the flat top surface 28 of the end portions 14 of the first exerciser 10, FIG. 2) and the similarly placed numeral "2" on the second exerciser 10' (FIG. 4). Similarly, a third or further exercisers may be added to this set, each with embedded supplemental weights 30 of progressively greater density resulting in the exercisers of the set being of progressively heavier weight. Each such further exerciser may be identified with suitable indicia thereon for distinguishing one exerciser from the other in a manner indicative of the differing weights of the exercisers and specifically of the differing weights of the equally weighted end portions of each of the exercisers of the set.

Exercisers according to the present invention may be fabricated by any of the fabrication processes well known in the rubber products manufacturing art.

Figure 5:
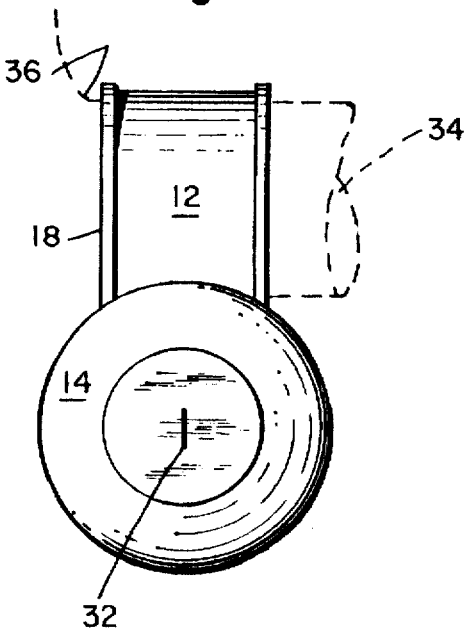
FIG. 5 is a side elevation view of the exerciser of FIG. 1 as placed on a penis (a fragment of which is illustrated in broken lines) of a person for practicing the method of the present invention.
Figure 6:
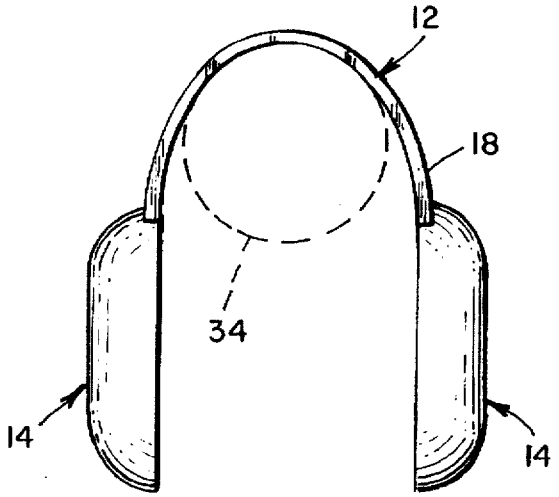
FIG. 6 is a front elevation view of the exerciser of FIG. 1 placed in accordance with FIG. 5.
Figure 7:
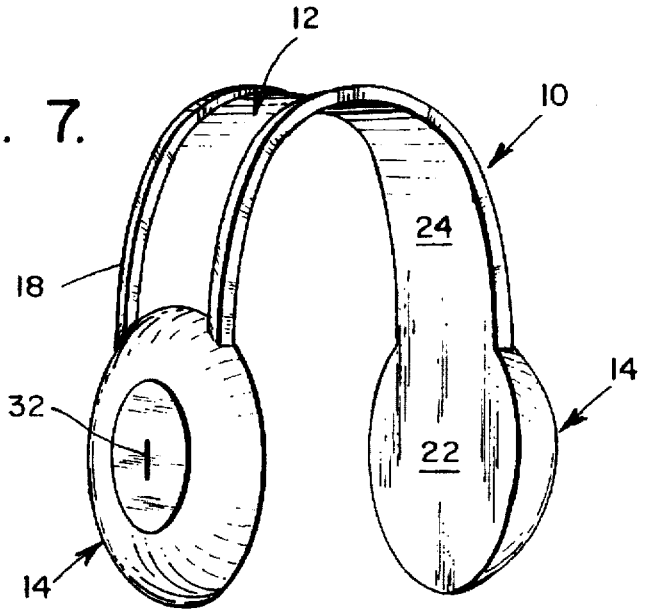
FIG. 7 is a side front perspective view of the exerciser of FIG. 1 as positioned in FIGS. 5 and 6 but without the penis being illustrated.

Turning to FIGS. 5, 6 and 7, the preferred manner of practicing the method of the present invention for exercising the pubococcygeus muscle of a male person, includes providing one of the exercisers 10 or 10' previously described, placing the exerciser on the erect penis 34 of the male person, preferably at or near the base 36 of the penis 34, such that the elongate member or strip 12 is flexurally retained on the penis transversely thereof with the weighted end portions 14 respectively dependent from opposite sides of the penis 34. The male person then performs Kegel exercises with the exerciser placed on his penis 34 as just described.

In order for the male person to perform the Kegel exercises, he must first locate his pelvic muscles which include the pubococcygeus muscle so that he may concentrate on these muscles during the exercises. As previously described, he may locate these muscles by squeezing his pelvic muscles while urinating to stop the flow of urine several times; the muscles which are squeezed to accomplish this are the ones which are used, and upon which the person must concentrate, for performing the Kegel exercises. His penis will move slightly if he performs a correct Kegel exercise while not urinating; Kegel exercises performed with a penile erection will cause the erect penis to move up and down.

The preferred manner of practicing the method of the present invention includes providing a set of a plurality of exercisers according to the invention, such as the set of two exercisers 10, 10' described above with respect to FIGS. 1–4. The example set includes a first exerciser 10 which is lighter in weight than the second exerciser 10'; if further exercisers are included in the set, the first exerciser 10 would be the lightest, or the least heavy, exerciser of the set. In an exercise program utilizing the method of the present invention, it is suggested that a beginner to the method start with the lightest exerciser (i.e. the first exerciser 10), and that he slowly work towards using the next heavier exerciser (i.e. the second exerciser 10') and then towards progressively heavier exercisers if provided in the set.

In one example of an exercise program in accordance with the present invention, the person may select the first exerciser 10 from the set of exercisers and place the exerciser 10 on his erect penis 34 with the exerciser's flexible strip 12 flexurally retained on the penis 34 at or near the penis's base 36, with the weighted end portions 14 of the selected exerciser 10 respectively dependent from opposite sides of the penis 34. With the exerciser 10 in place, the male person then begins a Kegel exercise program by squeezing and relaxing his appropriate pelvic muscles. Each such Kegel may be repeated to, say, eight to ten times completing one exercise set, or to a lesser number of Kegels if the person feels discomfort at any time. The exerciser 10 is, of course, removed at the conclusion of such exercises. As the appropriate pelvic muscles including the pubococcygeus muscle become stronger, the person may increase the number of exercise sets (eight to ten Kegels per set) to as many as three daily. After comfortably and effectively completing three sets of Kegel exercises, the person may discontinue using the lighter exerciser 10, and instead resume the exercise program by selecting and placing the heavier second exerciser 10' on his erect penis 34 with the exerciser's flexible strip 12 flexurally retained on the erect penis 34 at or near its base and transversely thereof with the weighted end portions 14 of the second exerciser respectively dependent from opposite sides of the penis 34. The person then performs Kegels with the second exerciser in place, such as in accordance with the exercise program just described with respect to the lighter first exerciser 10.

Thus, there has been described an exercise device and method for strengthening the pubococcygeus muscle of a male person by increasing the effectiveness of male Kegel exercises. Other embodiments and variations of the exerciser and method described herein may be developed without departing from the essential characteristics thereof. Accordingly, the invention should be limited only by the scope of the claims listed below.

We claim:

1. An exercise device for strengthening the pubococcygeus muscle of a male person comprising:

a flexible elongate member having weighted end portions of substantially equal weight, said elongate member including said weighted end portions being of rubber, said weighted end portions respectively include supplemental weights embedded therein, said supplemental weights having a density different than the density of said rubber, said elongate member adapted for being flexurally retained on an erect penis of the male person transversely of the penis with said weighted end portions respectively dependent from opposite sides of the penis while Kegel exercises are performed by the male person.

2. Exercise apparatus for strengthening the pubococcygeus muscle of a male person, comprising:

a plurality of exercisers each comprising a flexible elongate member having weighted end portions of substantially equal weight, the weight of each of said exercisers differing from the weight of the other exercisers of said plurality, the elongate member of each of said exercisers adapted for being flexurally retained on an erect penis of the male person transversely of the penis with the weighted end portions of the retained elongate member dependent from opposite sides of the penis while Kegel exercises are performed by the male person.

3. The apparatus according to claim 2, further including:

indicia on said exercisers respectively indicative of the differing weights of said exercisers.

4. The apparatus according to claim 2, wherein:

the weight of the weighted end portions of said exercisers differ from the weight of the weighted end portions of the other exercisers of said plurality.

5. The apparatus according to claim 4, further including:

indicia on said exercisers respectively indicative of the differing weights of said weighted end portions.

6. A method for exercising the pubococcygeus muscle of a male person, comprising the steps of:

(a) providing an exerciser comprising a flexible elongate member having weighted end portions;

(b) placing said exerciser on an erect penis of the male person such that said elongate member is flexurally retained on the penis transversely thereof with said weighted end portions respectively dependent from opposite sides of the penis; and (c) the male person performing Kegel exercises with said exerciser placed in accordance with step (b).

7. The method according to claim 6, wherein:

during step (b), placing said exerciser such that said elongate member is retained at or near the base of the penis.

8. The method according to claim 6, wherein:

during step (a), said end portions of said elongate member provided are substantially equally weighted of a predetermined weight.

9. The method according to claim 8, wherein:

during step (a), the weight of the weighted end portions of each of said exercisers provided differ from the weight of the weighted end portions of the other exercisers provided.

10. The method according to claim 6, wherein during step (a), said end portions of said elongate member provided are substantially equally weighted of a first predetermined weight; and further including the steps of (d) providing a second exerciser comprising a flexible elongate member having substantially equally weighted end portions of a second predetermined weight heavier than said first predetermined weight;

(e) discontinuing steps (b) and (c);

(f) placing said second exerciser on the erect penis of the male person such that said elongate member of said second exerciser is flexurally retained on the penis transversely thereof with said weighted end portions of said second exerciser respectively dependent from opposite sides of the penis; and (g) the male person performing Kegel exercises with said second exerciser placed in accordance with step (f).

11. The method according to claim 10, wherein:

during step (c), placing said selected exerciser such that said elongate member is retained at or near the base of the penis.

12. The method according to claim 6, wherein:

during step (a), said elongate member of said exerciser provided, including said weighted end portions, are of rubber.

13. The method according to claim 6, wherein:

during step (a), said elongate member of said exerciser provided includes a flexible strip having a first end and a second end, and said weighted end portions include a first weight secured to said first end and a second weight secured to said second end, said weights being of substantially equal weight.

14. The method according to claim 13, wherein:

during step (a), said strip and said weights of said exerciser provided are of rubber and said weights are integral with said strip.

15. The method according to claim 14, wherein:

during step (a), said first and second weights of said exerciser provided include supplemental weights embedded in said first and second weights.

16. A method for exercising the pubococcygeus muscle of a male person, comprising the steps of:

(a) providing a plurality of exercisers each comprising a flexible elongate member having weighted end portions of substantially equal weight, the weight of each of said exercisers differing from the weight of the other exercisers of said plurality;

(b) selecting one of said exercisers from said plurality;

(c) placing the selected exerciser on an erect penis of the male person such that the elongate member of said selected exerciser is flexurally retained on the penis with the weighted end portions thereof respectively dependent from opposite sides of the penis; and (d) the male person performing Kegel exercises with said selected exerciser placed in accordance with step (c).

* * * * *

UNITED STATES PATENT AND TRADEMARK OFFICE

CERTIFICATE OF CORRECTION

PATENT NO : 5,702,330

DATED : December 30, 1997

INVENTOR(S) : Michael A. De Monbrun, Dianne L. De Monbrun, Jammie Sant, and David M. Sant It is certified that error appears in the above-identified patent and that said Letters Patent is hereby corrected as shown below:

On the title page, in the "OTHER PUBLICATIONS" section,
third line, "Zilbegelo" should be --Zilbegeld--
fourth line, "Ove Sexuality" should be --Our Sexuality--
Column 1, line 18, "perineat" should be --perineal--
Column 4, line 48, "has" should be --had--
Column 7, line 55, change "claim 8" to --claim 16--
Column 8, line 19, change "claim 10" to --claim 9--

Signed and Sealed this

Twenty-fourth Day of November, 1998

*Attest:*

*Attesting Officer*

BRUCE LEHMAN

*Commissioner of Patents and Trademarks*